United States Patent [19]

Darrouzet

[11] 4,143,378

[45] Mar. 6, 1979

[54] PENDULUM ANTENNA

[75] Inventor: John L. Darrouzet, Dallas, Tex.

[73] Assignee: The United States of America as represented by the Secretary of the Department of Transportation, Washington, D.C.

[21] Appl. No.: 788,565

[22] Filed: Apr. 18, 1977

[51] Int. Cl.[2] ..... H01Q 3/26; H01Q 3/00; H01Q 1/12

[52] U.S. Cl. ..... 343/854; 343/878; 343/765

[58] Field of Search ..... 343/709, 710, 765, 854, 343/878, 886

[56] References Cited

U.S. PATENT DOCUMENTS

| | | | |
|---|---|---|---|
| 2,706,781 | 4/1955 | Goss, Jr. | 343/878 |
| 2,745,098 | 5/1956 | Cady | 343/878 |
| 3,860,931 | 1/1975 | Pope et al. | 343/709 |
| 3,968,496 | 7/1976 | Brunvoll | 343/765 |
| 4,020,491 | 4/1977 | Bieser et al. | 343/765 |

*Primary Examiner*—Alfred E. Smith
*Assistant Examiner*—Harry E. Barlow
*Attorney, Agent, or Firm*—Otto M. Wildensteiner; Harold P. Deeley, Jr.; Alva H. Bandy

[57] ABSTRACT

A pendulum antenna for a microwave landing system is disclosed. The antenna is an elevation scanning antenna of the phased array type. The aperture, phase shifters, drivers and power distribution manifolds form a column-like structure. The column is suspended like a pendulum inside a fiberglass radome and windshield. The column has a degree of freedom limited by stops, damping means, and lock member. The stops set the allowable pitch angle, the damping means prevents the antenna from swinging back and forth from wind gust effects, and the lock member is used to constrain the antenna during transportation. The radome is freely mounted in a base support having adjustable legs for antenna leveling.

16 Claims, 11 Drawing Figures

48
52
50
76
70
56
74
62
60
54
68
75
80
78
12

PENDULUM ANTENNA

This invention relates to microwave energy antennas, and more particularly, to an improved elevation radar antenna.

In the past radars have been used to measure height of targets. Several systems have been employed including a system using a symmetrical pencil-beam antenna. Another system obtains elevation information by stacking a number of narrow pencil beams in elevation and noting which beam contains the echo. Each of the stacked beams feeds an independent receiver. The stacked pencil beams may be generated with a single reflector antenna fed by a number of horns. The beams may also be generated with an array antenna whose elements are combined to form a number of overlapping beams.

In many radar applications a fan beam is used to search the required volume. A fan beam which is narrow in elevation angle and broad in azimuth angle is used to measure elevation. The antenna is a vertical linear array of radiating elements producing multiple stacked fan beams. For accurate measurements it is essential that the radiating signals be referenced to the vertical. Signals deviating from the vertical are corrected generally by electronically measuring any deviation of the antenna from the vertical and computing correction signals. Another solution has been to construct a level foundation for the antenna, and enclose the antenna in a radome.

The foundation must be very stable; i.e., it must resist soil movements which produce antenna settlement and tilting movements. Soil movements are produced by rain, drouths, and freezing temperatures. The radome must protect the antenna against these effects. Steady and gusty winds produce pitch and roll forces as well as turning forces on the radome. The radome can impart these forces onto the antenna or foundation or both depending on the construction. The movement of these structures has been the cause of one of the biggest problems associated with the accuracy of elevation antennas.

Accordingly, it is an object of the invention to provide an elevation scanning antenna which is substantially independent of structure movement.

Another object of the invention is to provide an elevation scanning antenna which is easy to fabricate, simple in construction, and of low weight.

Another object of the invention is to provide an elevation scanning antenna which can be quickly reoriented for changing aircraft landing patterns.

Still another object of the invention is to provide an elevation scanning antenna which is simple to erect on sloping and irregular surfaces.

Yet another object of the invention is to provide a mechanical structure for readily referencing the antenna to the local gravity vertical.

A further object of the invention is to provide an elevation scanning antenna with a mechanical structure substantially insensitive to pitch and roll movements and moments produced by wind and soil effects.

Still a further object of the invention is to provide an elevation scanning antenna free of boresight error.

Yet a further object of the invention is to provide an elevation scanning antenna which protects the antenna aperture from wind-driven rain damage, allows normal operation while dripping wet, and permits clearance of ice from all mechanical adjusting or leveling mechanisms.

Briefly stated the invention comprises an elevation scanning radiating antenna, which may be portable. The antenna includes a radiating aperture which is supported in the manner of a pendulum inside a cone shaped shroud that acts as a windshield and radome. The cone is mounted on a base. The antenna is equipped with a level adjustment mechanism, a damper mechanism, and a mechanical level indicator.

Other objects, features and advantages of the invention will become apparent from the following detailed description when read in conjunction with the accompanying drawings in which.

Figure 8A:
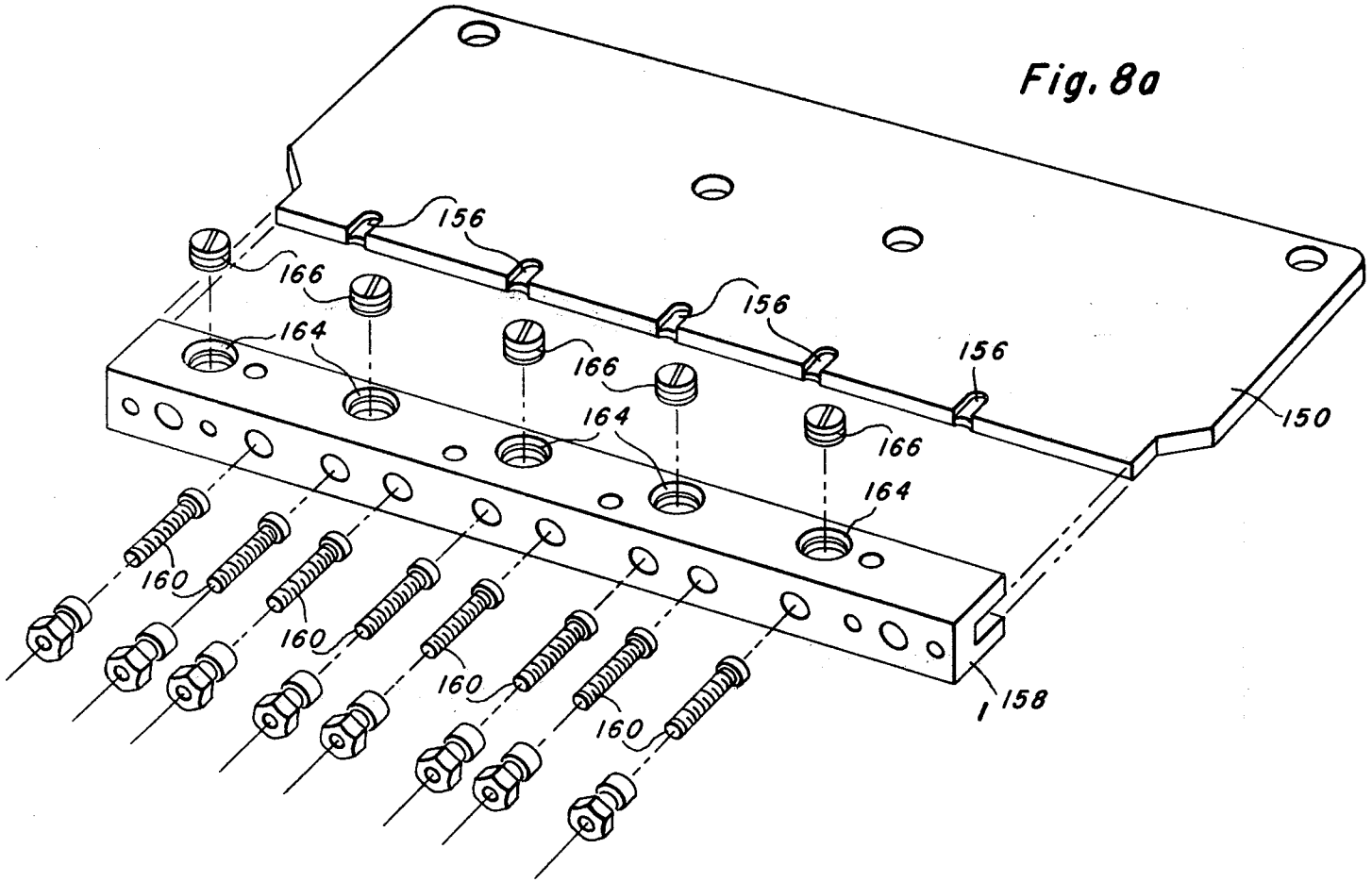
Figure 9:
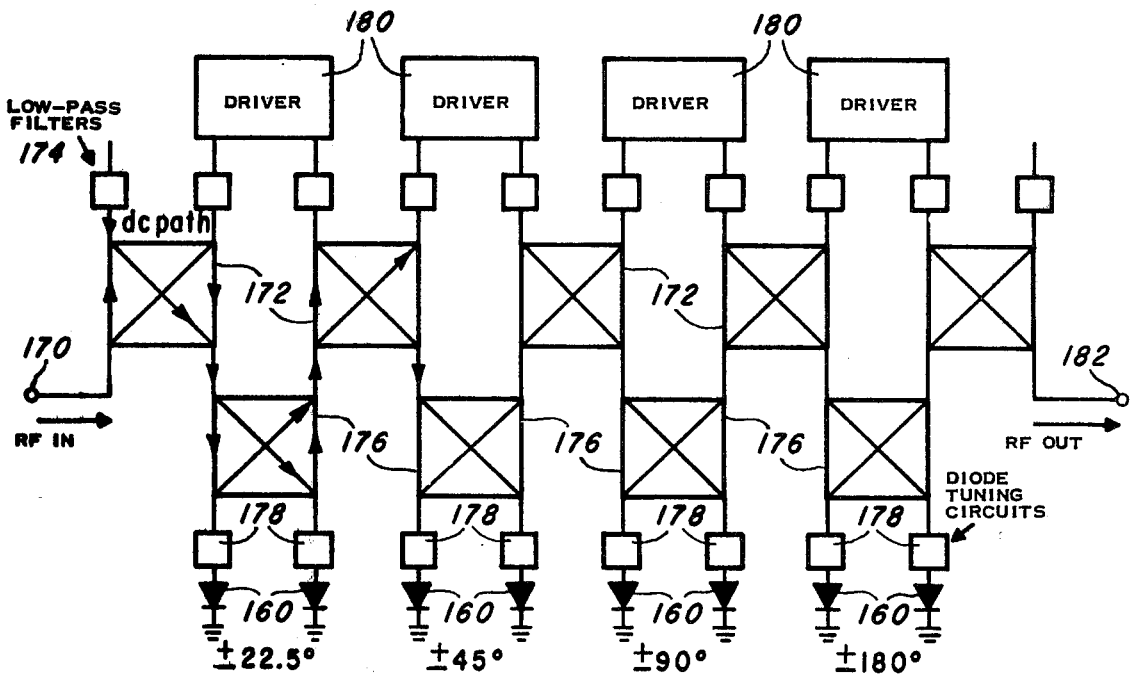

FIGS. 8a and b are views of the phase shifter unassembled and assembled;

FIG. 9 is a schematic view of the phase shifter; and

Figure 10:
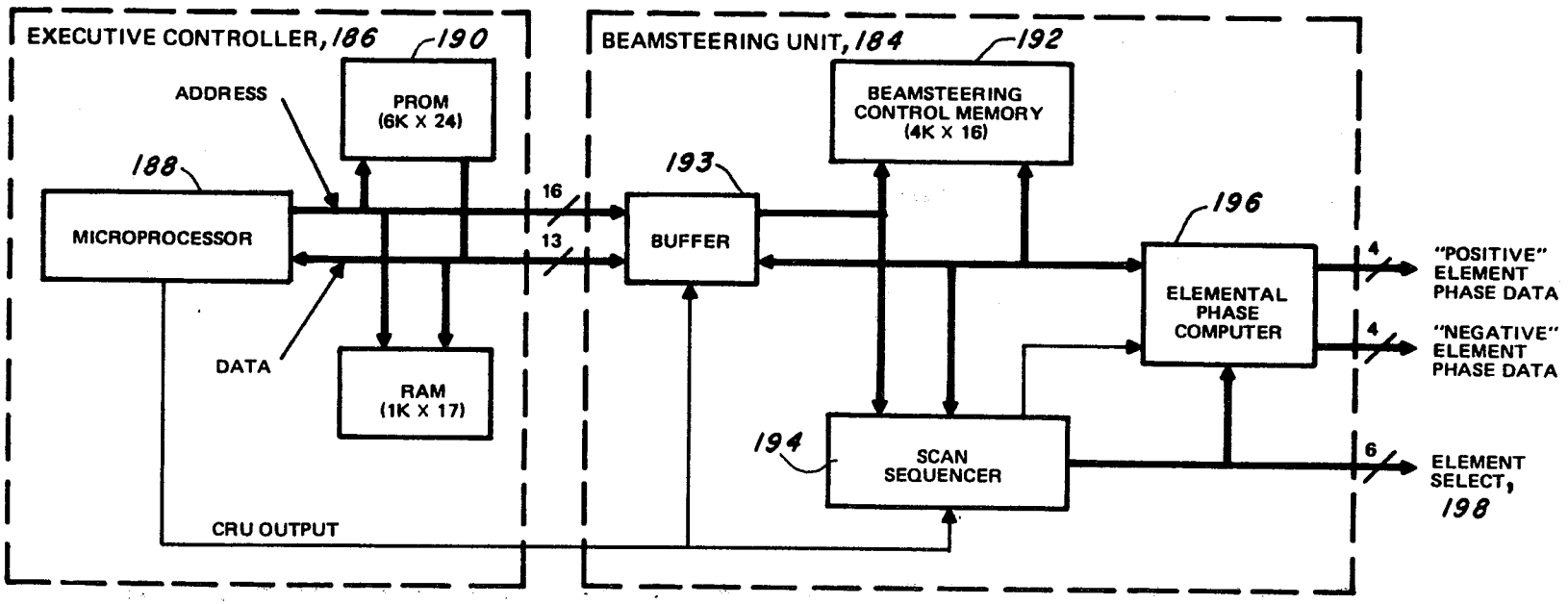

FIG. 10 is a block diagram of the executive controller and beam steering unit of the vertical antenna.

Figure 1:
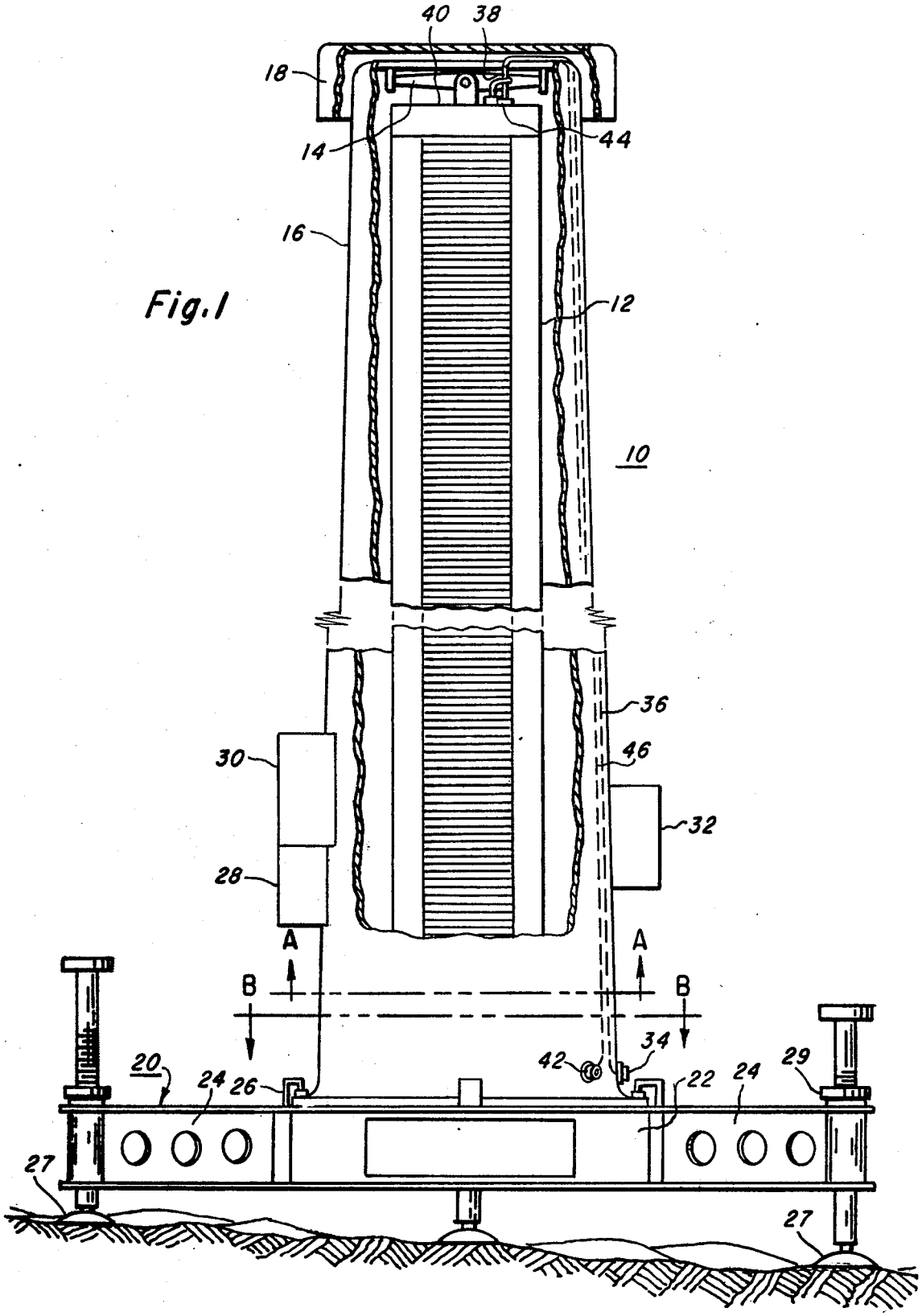
FIG. 1 is a fragmented isometric view of the elevation scanning antenna.

Referring now to FIG. 1, the elevation scanning antenna 10 is disclosed, for example, as a portable antenna which includes a phased array antenna aperture 12, a gimbal 14 which has two degrees of freedom, a thin walled, conically shaped shroud or radome 16 made, for example, of fiberglass, a vent cap 18, and a support mechanism 20.

The array antenna aperture 12, being sufficiently strong to support all required electronic packages, is suspended as a pendulum from the gimbals 14 located adjacent the top of the shroud and covered by the vented dome 18. The pendulum support insures a vertical array within, for example, 0.01 degree in 75 knot wind conditions. The shroud 16 is attached to the support member 20. Its open bottom is screen covered to keep insects out while permitting air to circulate through the shroud and out the vent dome.

The support member 20 includes a cylinder 22 centered among three equally spaced adjustable legs 24. The shroud 16 can be rotated about its vertical axis in the cylinder 22 to align the array antenna aperture with the runway or wind for a helicopter pad. When aligned the shroud is clamped into position by clamps 26. The legs 24 have adjustable foot pads 27 for correct leveling to, for example, ± 0.25 degree on irregular surfaces having a minimal 10 degree slope.

The shroud 16 is provided with external mounts 28, 30, and 32 for optional electronic packages such as, for example, a sector identification (ID) antenna, DME antenna and SP2T switch for split site operation. Split site operation is where the elevation antenna is positioned apart from an azimuth antenna. Further, provision is also made for mounting a DME antenna for use when the DME is located at the elevation site in a split-site configuration. The DME antenna has selectable sector or omni coverage. Possible locations are on top of the shroud cap 18 for omni coverage and on the side of the shroud for sector-only coverage.

A coax connector 34 is mounted on the shroud adjacent its base for connecting RF energy from a source (not shown). A coax cable 36 is attached to the inside of the shroud 16 and is connected to a flexible coax cable 38 for routing through the gimbal 14 to a coax connector 40 mounted in the top center of the aperture antenna 12. A suitable cable is flexible RG-141-A/U Coax Cable. A bus connector 42 is also attached to the shroud 16 adjacent the coax connector for coupling logic signals from a beam steering unit 184 hereinafter described. A bus 44 is secured to the interior surface of the shroud 16 and terminates in a ribbon cable 46 routed through the gimbal 14 to the aperture antenna. The ribbon cable 46 is formed in a helix pattern near the flexible coax cable 36.

Figure 2:
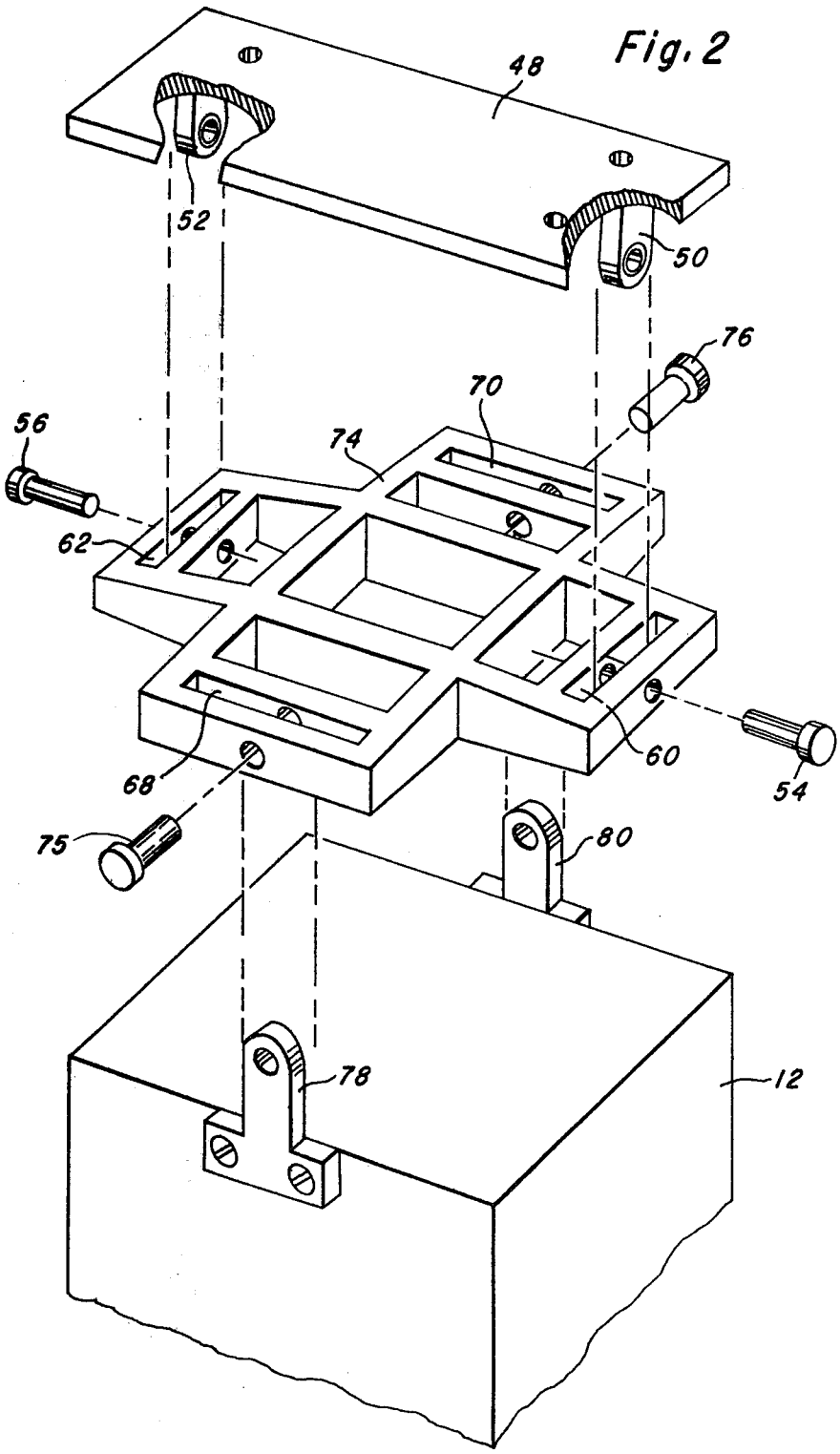
FIG. 2 is an exploded isometric view of the gimbal mount for the antenna aperture.

The gimbal system 14 (FIG. 2) is a two gimbal configuration. It comprises a bar 48 having ends attached to the shroud 16 (FIG. 1). Trunnions 50 and 52 (FIG. 2) suspend in a spaced relationship from the bar 48. The trunnions 50 and 52 are provided with bearings for supporting wrist pins 54 and 56 of crossbar 74. The wrist pins 54 and 56 are mounted in trunnion slots 60 and 62 axially aligned adjacent ends of opposing arms of crossbar 74. Crossbar 74 also has slots 68 and 70 adjacent ends of opposing arms. Opposing arms are normal to opposing arms. Wrist pins 75 and 76 are mounted in slots 68 and 70. Upwardly extending trunnions 78 and 80, attached to opposing sides of the array antenna aperture 12, are provided with bearings for mounting on the wrist pins 75 and 76. Thus, the array antenna aperture antenna 12 remains in the vertical as the shroud pitches and rolls in response to wind and soil effects. Only when the antenna reaches stops, which may be, for example, the walls of the shroud 16, does the pitch angle affect the beam pointing angle. The stop limit is set at 0.25 degrees, because this is the maximum pitch angle allowed generally for this type of antenna for power reasons.

Analysis of the radome structure shows the movement of the aperture antenna to be less than 0.01 degree with winds up to 75 knots. This is less than the ± 0.25 degree swing limit; so, the antenna will remain vertical within the design limits in winds up to 100 mph.

Figure 3:
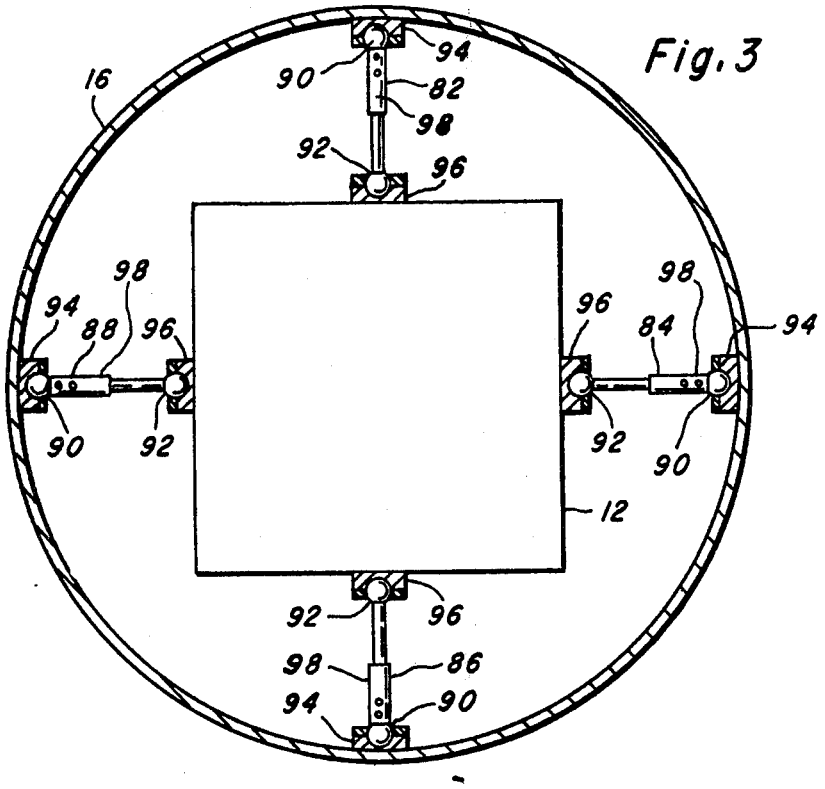
FIG. 3 is a cross-sectional view of the elevation scanning antenna taken along line A—A of FIG. 1.

Nevertheless, in gusty winds the array antenna aperture may swing to and fro. To substantially reduce this to/fro movement, a damping means is provided. The damping means (FIG. 3) comprises, for example, equally spaced dampers 82, 84, 86, 88. Each damper has ball ends 90 and 92 mounted in sockets 94 and 96 attached, respectively, to the shroud 16 and array antenna aperture 12. Each damper includes a piston (not shown) inside a cylinder 98 that contains air. When the shroud or aperture antenna moves, the piston pushes against the air in the cylinder. The air resists the piston. This resistance to the motion of the piston offsets the force between the swinging array antenna aperture and shroud.

Figure 4:
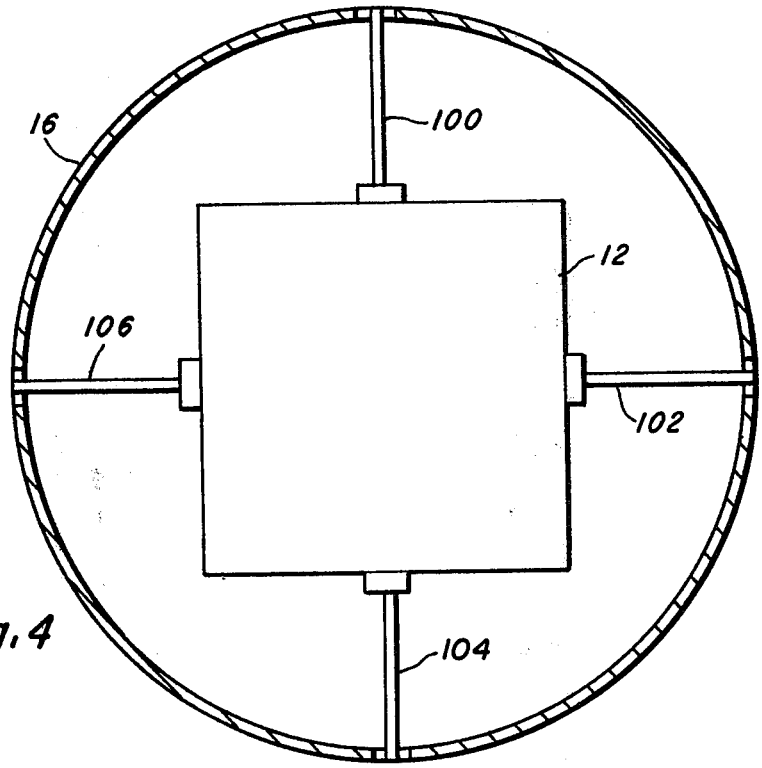
FIG. 4 is a cross-sectional view of the elevation scanning antenna taken along line B—B of FIG. 1.

Because of the 0.25 degree stop limit the array antenna aperture must be leveled to within ± 0.25 degrees; leveling is accomplished by selectively manipulating the three adjustable foot pads 27 of the shroud support 20 (FIG. 1). The foot pads are threadedly mounted in legs 24 and equipped with lock nuts 29 for securing the level adjustment. To determine when the shroud support is level, a mechanical leveling means is provided which comprises four equally spaced arms 100, 102, 104, and 106 (FIG. 4) attached to the array antenna aperture 12. The aperture arms 100–106 extend horizontally from the array antenna 12 through corresponding holes in the shroud 16. The length of the arms are such that their ends extending through the holes are flush with the outer surface of the shroud 16 when the elevation antenna is level. Until level one or more of the arms will protude through the holes and the protrusions may be felt. When the antenna is level, the arms cannot be felt, thus, the leveling can be accomplished independently of light conditions.

Figure 5:
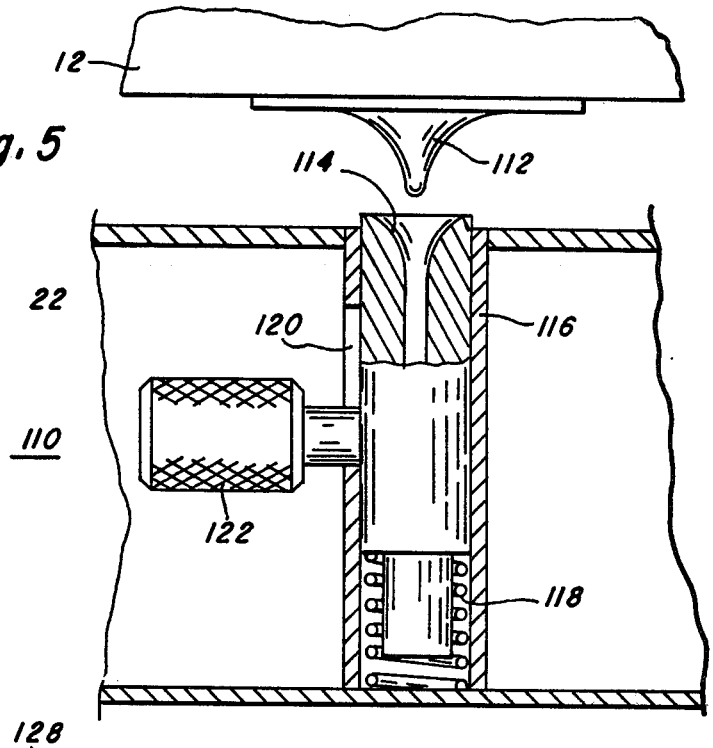
FIG. 5 is a fragmented view partly in section of the antenna aperture locking mechanism.

An array antenna aperture locking means 110 (FIG. 5) is provided for securing aperture antenna 12 against movement during transportation of the unit. The locking means 110 includes a substantially conically shaped male member 112 having its base attached to the bottom of the array antenna aperture 12 and its apex extending toward the cylinder 22 of the support. A corresponding female member 114 is mounted in cylinder 116. The female member 114 is biased upwardly by a spring 118 mounted in the cylinder 116 beneath the female member 114. A "J" shaped slot 120 is provided in the cylinder 116. A knurled knob 122 is attached to the female member through the "J" shaped slot. The cylinder 116 of the lock is supported by the shroud support cylinder 22. To unlock the array antenna aperture, the knurled knob is pushed down the vertical portion of the "J"slot and rotated into the horizontal portion where it is locked by the bias of the spring 118.

Figure 6:
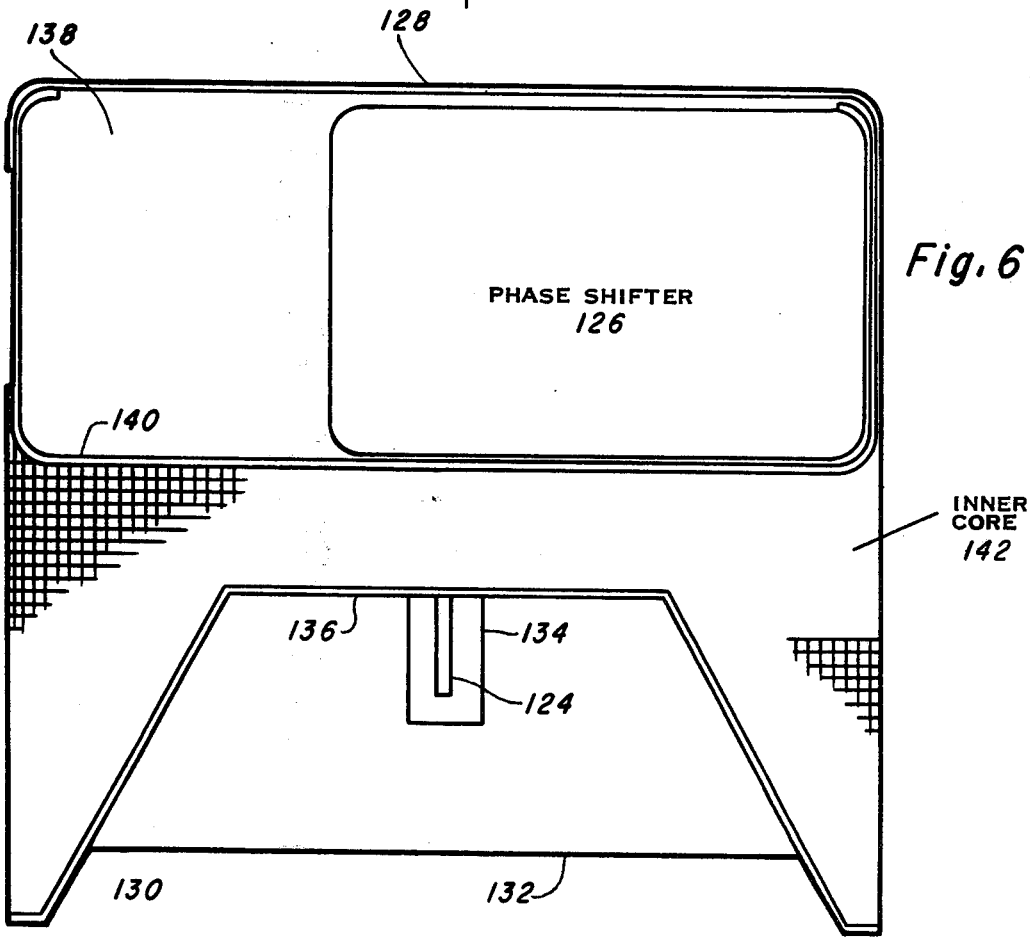
FIG. 6 is a fragmented cross-sectional view of the elevation antenna support.

The elevation scanning antenna system (FIG. 6) is a phased array system which comprises a linear array of vertically disposed elevation radiating elements 124, a plurality of phase shifters 126 with driver circuits, and an RF manifold 128 all of which are mounted in a radiating aperture 130. The radiating aperture includes a dual flared horn aperture which is continuous along the full length of the array of dipoles 124. The flared surfaces of the horn extend from a "U" shaped channel member in which the elements (dipoles) of the aperture antenna are embedded in a suitable material 132, such as an expanded synthetic resinous material sold under the trademark Styrofoam.

In the preferred embodiment the array antenna aperture includes 46 dipoles of which 44 are driven and two are terminated to minimize edge effects. The dipoles are etched on low-loss printed circuit material with a stripline feed allowing accurate fabrication and low weight. The dipole structure is embedded in fiberglass 134 for support. Each dipole is 0.5 wavelength long, located 0.25 wavelength above the ground plane 136. The dipoles are spaced 0.756 wavelength to prevent the appearance of grating lobes at maximum scan. The dual flared horn 130 shapes the array azimuth pattern for centerline emphasis. The active length of the antenna aperture is sufficient to give a two degree half-power beamwidth. A 30dB Taylor weighted amplitude is used to give low-elevation side lobe levels.

The array of dipoles 124 is connected to a corresponding array of four bit diode phase shifters 126 for scanning. The phase shifters 126 are modules removably mounted in a compartment 138 formed in the "U" shaped aperture by partition 140. The space 142 between the partition 140 and the horn reflector, which form the inner core, is filled with a suitable lightweight plastic material to add strength to the aperture antenna.

Figure 7:
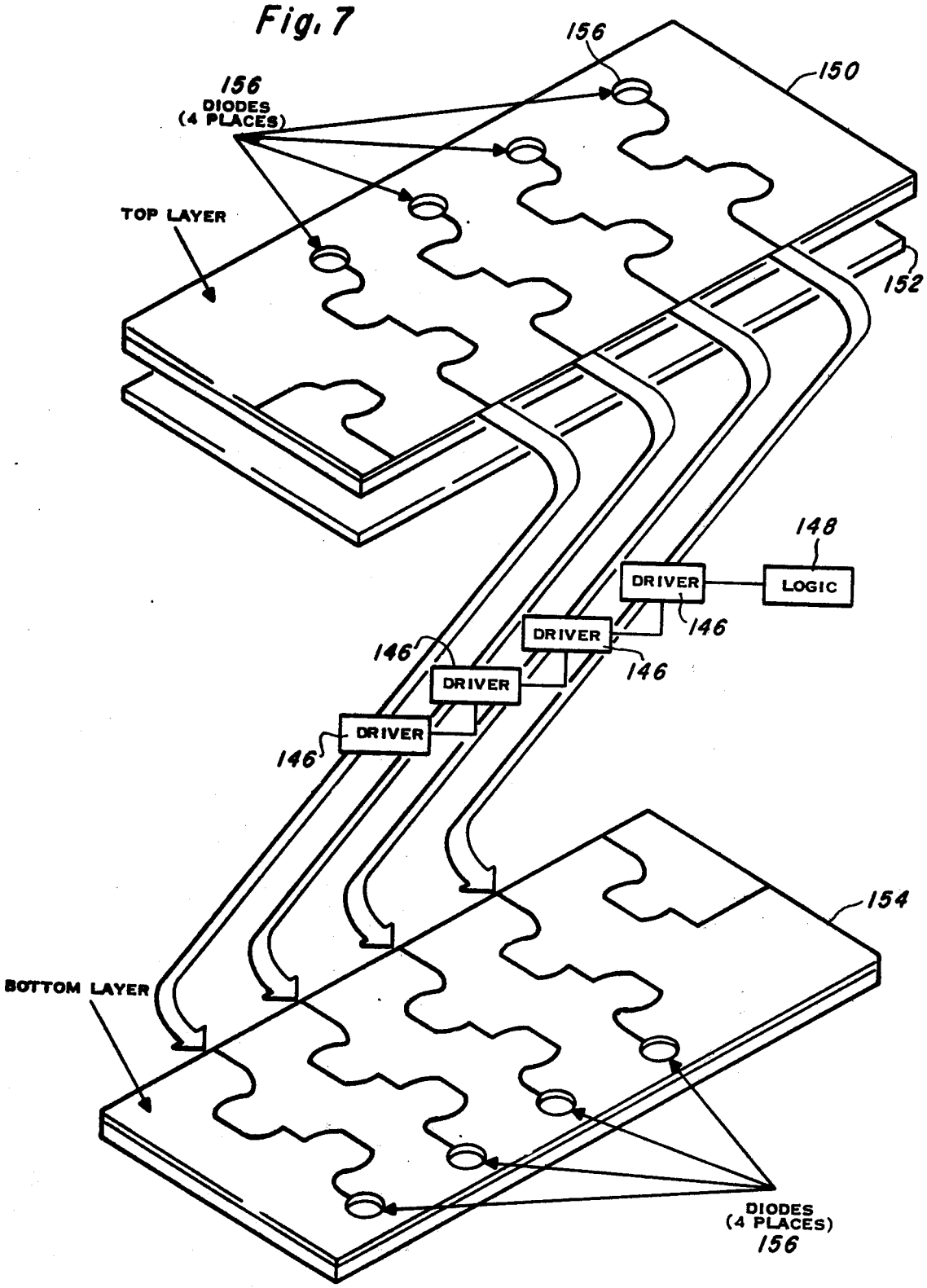
FIG. 7 is an exploded view of the phase shifter with parts removed to show the stripline fabrication.

Each phase shifter 126 (FIG. 7) includes a bonded stripline assembly containing the driver circuitry 146 for diodes (not shown), built in test circuitry, and a portion of the beam steering electronics 148. The stripline assembly is a bonded stripline composed, for example, of three layers 150, 152, and 154 of a glass-reinforced synthetic resin polymer sold as Rogers Duroid 5880 glass reinforced Teflon. Conductor or coupler patterns are photoetched on the center board layer and connector holes 156 are formed in the top and bottom layers. The boards 150–154 (FIG. 7) are laminated together using a sheet adhesive of electrical properties identical to the stripline material. Provision for a diode and connector mounting is provided by a tin plated aluminum bar 158 (FIG. 8*a*) connected to the bonded sandwich. The aluminum bar for the diodes and the sandwiched boards are joined together so that holes 164 of the bar are located over the cutouts 156 in the stripline leaving portions of the coupler exposed.

Figure 8B:
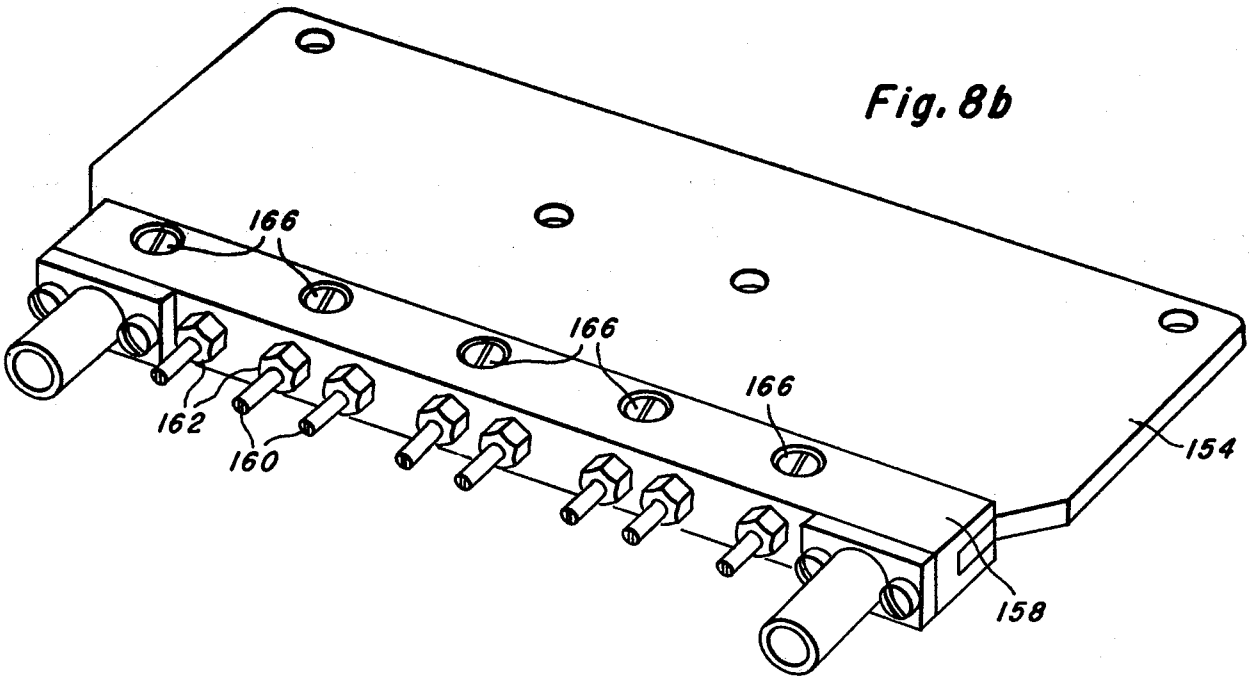

Microwave power diodes 160, such as, for example, PIN diodes, are then mounted on bolt type holding fixtures 162 and the diode holding fixtures inserted in the side of the aluminum bar 158. The fine leads of the diodes are then bonded to the stripline couplers through holes 164 in the top of the bar 158. Dielectrics are then placed over the stripline cutouts and the holes 164 plugged with the screws 166 (FIG. 8*b*).

The phase shifter 126 being a four bit PIN diode phase shifter uses two diodes 160 per bit; thus, eight diodes are required. The phase shifter 126 is shown schematically in FIG. 9 as a hybrid-coupled-reflection phase shifter. RF energy provided as an input to terminal 170 is applied to a plurality of hybrids or directional couplers 172. The RF energy is divided by the first directional coupler 172 connected to low-pass filters 174. The low-pass filters 174 reflect the RF energy through a second directional coupler 176. The RF energy is divided by the directional coupler 176 and connected to a pair of diode tuning circuits 178. The diode tuning circuits are connected to the anodes of a pair of diodes 160. The diodes 160 reflect the RF energy back through the second directional coupler 176 to the next directional coupler 172 and the cycle progressively repeated to the output terminal 182. The diodes 160 are driven by driver 180 and the RF energy selectively shifted in phase by the action of the driver circuits 180 on the diodes 160 to provide at the output terminal 182 signals of proper phase for transmission by its corresponding dipole 124.

In this fashion, an RF signal incident upon a hybrid-coupled reflection phase shifter divides to produce equal signals at the outputs of the first quadrature coupler, where it is reflected from the diodes 160 and their tuning circuits 178 to the input of the succeeding coupler. The differential phase shift provided by a single bit of the four bit phase shifter is the difference in the reflection coefficient of the diodes and its tuning circuit in the two bias states (on or off). The circuitry 178 used at hybrid outputs to set bit phase shift values can take several forms. The preferred form utilizes quarter-wave transformers preceding the diodes 160. With this tuning configuration the 180-degree bit is the basic building block from which the bits are constructed. Use of the impedance transformers causes the two impedance points to rotate toward each other so that the angular separation between the points in the reflection coefficient plane is less than 180 degrees to provide smaller bit values. The quadrature couplers are composed of two tandem connected broadside coupled elements which enables the use of the stripline composed of the three dielectric layers 150, 152, and 154.

The driver board contains the logic and drivers for the individual diodes and the diode reverse and forward current monitoring circuits.

The RF distribution manifold 128 (FIG. 6) is a stripline implementation of directional couplers which feeds the input of each phase shifter 126 with the 30db Taylor-weighted amplitude distribution. A signal bus delivers power and logic signals that control each bit of each of the 44 phase shifters to scan the beam.

A beam steering unit 184 (FIG. 10) provides the necessary digital controls which precisely steer the phased array antenna beam at the required scan rate which is, for example, 20,000 degrees/second. The output of the beam steering unit is a set of time sequenced pulse shift commands which drive each antenna element phase shifter device 126 to effect the required to/fro beam scan sequence. Each scan sequence is remotely initiated by an antenna electronics group executive controller 186. The beam steering unit, once initiated, automatically controls the entire beam scan sequence while also generating timed commands which govern RF power on/off status during the to/fro cycles. The RF on/off control is used to establish sector coverage requirements. The elevation antenna scan capability is zero to twenty-one degrees. The coarse step intervals are at 0.2 degree increments. The lower sector limit is adjustable from zero to six degrees in 0.2 degree increments.

The beam steering unit 184 is a programmable special-purpose digital logic device which performs in concert with the executive controller microprocessor 188. The microprocessor 188 is programmed to compute the phase values for each phase shifter and each coarse scan step, and stores these values in memory 190. This is a start-up calculation that will require about one second. During the scan, the phase values are withdrawn from memory at the fast, real time rate; thus, much of the high-speed computational logic is eliminated. The result is a substantial saving in power and space.

More specifically, the microprocessor 188 executes, with the aid of "scratch pad memory" 191, a program stored in the programmable read only memory (PROM) 190 and loads the beam steering memory 192 with seven bits of phase shifter data for each phase shifter and each coarse scan step for the elevation scans. To aid the loading of the beam steering memory, it is loaded through a buffer 193 which provides compensation for the difference in operating speeds. To scan the antenna the microprocessor selects an elevation scan through the scan sequencer 194, sends the phase reference for the scan to an elemental phase shifter, and sends a scan timing signal to the scan sequencer 194 to start the scan.

At the proper time, the scan sequencer addresses the memory 192 and loads the phase shifter value into the elemental phase computer 196. The seven bit phase commands are rounded with a phase randomizing routine to four bits by the elemental phase computer 196 and sent to the phase shifter drive board selected by the scan sequencer through the element select bus 198.

Although only a single embodiment of this invention has been described herein, it will be apparent to a person skilled in the art that various modifications to the details of construction shown and described may be made without departing from the scope of this invention.

What is claimed is:

1. An elevation scanning antenna comprising:

(a) a shroud;
(b) a gimbal means mounted in said shroud; and
(c) an array antenna aperture suspended from said gimbal means, said gimbal means supporting said array antenna aperture in a manner to overcome motion induced by extraneous forces such as long-term ground movement or aerodynamic forces.

2. An elevation scanning antenna according to claim 1 further comprising a damper means interconnecting the shroud and array antenna aperture for stabilizing the array antenna aperture against shroud pitch and roll.

3. An elevation scanning antenna according to claim 1 wherein said gimbal means is a two-degree-of-freedom gimbal.

4. An elevation scanning antenna according to claim 1 wherein the array antenna aperture is a phased array.

5. An elevation scanning antenna according to claim 1 wherein the array antenna aperture comprises an array of microwave energy transmitting elements for transmitting an elevation scanning beam of RF energy, a plurality of phase shifters connected to the array of microwave energy transmitting elements for varying the phases of the RF energy applied to the array of microwave energy transmitting elements, an RF manifold connected to the plurality of phase shifters for feeding RF energy from a source thereof to the plurality of phase shifters, and a channel member having closed ends and arm portions having outwardly flared surfaces, said RF manifold, plurality of phase shifters and array of microwave energy transmitting elements mounted in said channel member with the array of microwave energy transmitting elements positioned as to the flared arm surfaces of the channel member to form a horn antenna.

6. An elevation scanning antenna according to claim 1 further comprising an adjustable support attached to the shroud for leveling the shroud.

7. An elevation scanning antenna according to claim 6 wherein the adjustable support includes a cylinder and shroud positioning retainer, whereby said shroud may be rotated on the cylinder for selectively positioning the array antenna aperture and retained by the shroud positioning retainer.

8. An elevation scanning antenna according to claim 6 further comprising a mechanical means for indicating when the shroud is level.

9. An elevation scanning antenna according to claim 6 further comprising a mechanical means for indicating when said shroud is level, said means including a plurality of spaced arms attached to said array antenna aperture and extending radially therefrom, and a corresponding plurality of apertures in said shroud, the lengths of said arms being such as to place their ends in said corresponding apertures substantially flush with the exterior surface of said shroud when said shroud is level.

10. An elevation scanning antenna according to claim 8 wherein the adjustable support means further includes a locking means for locking the array antenna aperture to the adjustable support means during transportation.

11. An elevation scanning antenna according to claim 10 wherein the locking means for locking the array antenna aperture to the adjustable support means comprises a locking member attached to the array antenna aperture, and a corresponding locking member attached to the adjustable support means.

12. An elevation scanning antenna according to claim 11 wherein the locking member attached to the array antenna aperture is a male member, and the corresponding member is a female member.

13. An elevation scanning antenna according to claim 12 wherein said locking means further comprises a cylinder having a handle retaining slot formed in the wall thereof, a spring mounted in the bottom portion of the cylinder, the female member positioned in the cylinder for biasing by the spring, and a handle having a shaft extending through the handle retaining slot in the cylinder and an end attached to the female member, whereby the female member may be moved downwardly from the male member, against the spring and locked in the handle retaining slot to unlock the array antenna aperture.

14. An elevation scanning antenna according to claim 5 wherein the array of microwave energy transmitting elements are embedded in an expanded synthetic resinous material formed between the flared arm surfaces of the channel member for strengthening the array of microwave energy transmitting elements.

15. An elevation scanning antenna according to claim 5 wherein each of the phase shifters comprises a circuit patterned plate, a top plate, and a bottom plate forming a three layered stripline sandwich having conductor patterns etched therein, said top and bottom plates having a plurality of apertures with the conductors exposed in the plurality of apertures in the top and bottom plates, a metal bar having a slotted edge opposing an edge having a plurality of apertures formed therein and top and bottom surfaces each having a plurality of threaded apertures therein corresponding to the plurality of holes in the top and bottom plates, said three layered stripline sandwich inserted in the slotted edge of the metal bar with the plurality of holes in the top and bottom surfaces aligned with the holes of the top and bottom plates, a plurality of diodes mounted in the plurality of holes in the edge of said metal bar, said diodes having leads coupled to the conductors of the three stripline forming boards, and a plurality of screw caps for closing the apertures of the top and bottom surfaces of the metal bar.

16. An elevation antenna according to claim 3 wherein said two-degree-of-freedom gimbal comprises a bar having ends attached to the shroud, a pair of spaced trunnions depending from the bar, a cross bar having a first set of oppositely disposed ends attached to the trunnions of the bar and a second set of oppositely disposed ends substantially normal to the first set, and a pair of spaced trunnions having ends rotatably mounted on the second set of oppositely disposed ends of the crossbar and opposing ends rigidly connected to the array antenna aperture.

* * * * *